US006218990B1

(12) United States Patent
Grangeat et al.

(10) Patent No.: US 6,218,990 B1
(45) **Date of Patent: *Apr. 17, 2001**

(54) RADIOCOMMUNICATION DEVICE AND A DUAL-FREQUENCY MICROSTRIP ANTENNA

(75) Inventors: Christophe Grangeat, Sevres; Pascal Herve, Paris; Laurence Lorcy, St Fargeau Ponthierry; Charles Ngounou Kouam, Les Ulis, all of (FR)

(73) Assignee: Alcatel, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/295,370

(22) Filed: Apr. 21, 1999

(30) Foreign Application Priority Data

Apr. 30, 1998 (FR) ..... 98 05542

(51) Int. Cl.[7] ..... H01Q 1/38
(52) U.S. Cl. ..... 343/700 MS; 343/846
(58) Field of Search ..... 343/700 MS, 846, 343/848, 830, 829, 767; H01Q 1/38

(56) References Cited

U.S. PATENT DOCUMENTS

| | | | |
|---|---|---|---|
| 4,040,060 | 8/1977 | Kaloi | 343/700 MS |
| 4,766,440 | 8/1988 | Gegan | 343/700 MS |
| 4,771,291 | 9/1988 | Lo et al. | 343/700 MS |
| 5,400,040 | 3/1995 | Lane et al. | 343/700 MS |
| 5,917,450 * | 6/1999 | Tsunekawa et al. | 353/700 MS |

FOREIGN PATENT DOCUMENTS

WO 94/14210 6/1994 (WO) .

OTHER PUBLICATIONS

A. Boag et al, "Dual Band Cavity–Backed Quarter–Wave Patch Antenna" IEEE Antennas and Propagation Society, International Symposium Digest, Newport Beach, Jun. 18–23, 1995, Held in Conjunction with the USNC/URSI National Radio Science Meeting, vol. 4, Jun. 18, 1995, pp. 2124–2127, XP000588906, Institute of Electrical and Electronics Engineers.

T. D. Ormiston et al, Microstrip Short–Circuit Patch Design Equations Microwave and Optical Technology Letters, vol. 16, No. 1, Sep. 1997, pp. 12–14.

* cited by examiner

*Primary Examiner*—Hoanganh Le
(74) *Attorney, Agent, or Firm*—Sughrue, Mion, Zinn, Macpeak & Seas, PLLC

(57) ABSTRACT

An antenna has a patch with a rear edge provided with a short circuit enabling a quarter-wave resonance to be established. A half-wave resonance can also be established between two lateral edges of the patch. The same coupling device couples the antenna to a transmitter or receiver for each of the two resonant frequencies. It includes a coupling strip penetrating the patch between the edges of a slot extending from one lateral edge. The antenna is particularly applicable in dual mode mobile telephone system using GSM and DCS standards.

10 Claims, 2 Drawing Sheets

RADIOCOMMUNICATION DEVICE AND A DUAL-FREQUENCY MICROSTRIP ANTENNA

The present invention is generally concerned with radiocommunication devices, in particular mobile telephones, and it is more particularly concerned with microstrip antennas for use in such devices. An antenna of this kind is known as a "microstrip patch antenna" and includes a patch which is typically formed by etching a metallic layer.

BACKGROUND OF THE INVENTION

The microstrip technique is a planar technique used to produce lines conveying signals and antennas coupling such lines and radiated waves. It uses conductive strips and/or patches formed on the top surface of a thin dielectric substrate separating them from a conductive layer on the bottom surface of the substrate and constituting a ground for the line or antenna. A patch is typically wider than a strip and its shape and dimensions are important features of the antenna. The substrate is typically a plane rectangular sheet of constant thickness and the patch is also typically rectangular. This is not obligatory, however. In particular, varying the thickness of the substrate, for example exponentially, widens the bandwidth of an antenna of the above kind, and the shape of the patch can in particular be circular. The electric field lines extend between the strip or patch and the ground layer through the substrate.

The technique differs from various other techniques that also employ conductive elements on a thin substrate, in particular the coplanar line technique in which the electric field is established on the top surface of the substrate and symmetrically between a central conductive strip and two circular areas on respective opposite sides of the strip, from which they are separated by respective slots. In the case of an antenna, a patch is surrounded by a continuous conductive area from which it is separated by a slot.

Antennas using the above techniques are typically, although not exclusively, resonant structures which are the site of standing waves enabling coupling with radiated waves.

A broad distinction can be drawn between diverse types of resonant structure that can be made using the microstrip technique and which correspond to respective modes of resonance of the structure. A first type is the commonest one and might be called the "half-wave" type. Taking one dimension of the patch as its length, in a direction called the longitudinal direction, the length is typically substantially equal to one half-wave, i.e. to half the wavelength of an electromagnetic wave propagating in that direction in the line comprising the ground, the substrate and the patch. The antenna is then called a "half-wave" antenna. That type of resonance can be generally defined by the presence of an electric current node at each of the two ends of the length, which can therefore also be equal to said half-wave multiplied by an integer other than 1. This number is typically an odd number. Coupling with radiated waves occurs at the ends of the length, in regions where the amplitude of the electric field in the substrate is maximum.

A second type of resonant structure that can be produced using the same technique might be called the "quarter-wave" type. It differs from the half-wave type in that the patch typically has a length substantially equal to one-quarter wave, i.e. to one-fourth of a wavelength, the length of the patch and the wavelength being defined as above. In this case the antenna is called a "quarter-wave" antenna. It is also different in that there is a clear short-circuit at one end of the length between the ground and the patch in order to impose a "quarter-wave" resonance mode. This type of resonance can be generally defined by the presence of an electric field node fixed by the short-circuit at one end of the length of the patch and by an electric current node at the other end of the length. The length can therefore be equal to an integer number of half-waves added to said quarter-wave. Coupling with the radiated waves occurs at the other end of the length, in the region in which the amplitude of the electric field through the substrate is maximum.

Other resonance modes can be established in planar antennas. They depend in particular on:

- the configuration of the patches, which can incorporate slots, possibly radiating slots,
- the possible presence and location of short-circuits and electric models representative of short-circuits, which are not always equivalent, even approximately, to perfect short-circuits, for which the impedance would be zero, and
- the possible presence and location of coupling devices in the antennas for coupling their resonant structures to a signal processing unit such as a transmitter.

There may be a plurality of resonance modes for a given antenna configuration, enabling the antenna to be used at a plurality of frequencies corresponding to those modes.

The present invention is particularly characterized by choosing certain "resonance paths", as explained hereinafter. The meaning of the expression "resonance path" as used hereinafter will now be defined:

Each resonance mode can be described as the result of superposing two waves propagating in opposite directions on the same path and reflected at the two ends of the path alternately. The path is imposed by the components of the antenna. It constitutes the "resonance path" for this resonance mode. It is rectilinear and longitudinal in the case of the half-wave and quarter-wave antennas previously mentioned. However, it can also be a curved radiating slot. In all cases the resonant frequency is inversely proportional to the time for which a traveling wave travels along the resonance path (see above). The expression "resonance mode" is sometimes replaced below by the term "resonance".

An antenna is typically coupled to a single processor unit such as a transmitter by a connection system including a coupling device incorporated in the antenna and a connection line external to the antenna connecting the coupling device to the signal processor unit.

In the case of a resonant structure transmit antenna, the respective functions of the coupling device, the connection line and the antenna are as follows: the function of the connection line is to convey a radio frequency or microwave frequency signal from the transmitter to the terminals of the antenna. The signal propagates along the whole of a line of this kind in the form of a traveling wave without its characteristics being significantly modified, at least in theory. The function of the coupling device is to convert the signal supplied by the connection line into a form in which it excites a resonance of the antenna, i.e. so that the energy of the traveling wave conveying the signal is transferred to a standing wave established in the antenna with characteristics defined by the antenna. Transfer is generally imperfect, i.e. the coupling device reflects some of the energy towards the connection line, which causes an unwanted standing wave in the line. The corresponding standing wave ratio varies as a function of frequency and the diagram of that variation defines the bandwidth(s) of the antenna. The antenna transfers energy from the standing wave to a wave radiated in space. The signal supplied by the transmitter is transformed a first time from a traveling wave to a standing wave and a second time into a radiated wave. In the case of a receive antenna, the signal takes the same forms in the same units but in the reverse order.

The coupling device and the connection line can be implemented using a technique other than the microstrip technique, for example in the form of coaxial or coplanar lines. To limit unwanted reflections their nature and dimensions are chosen to match the impedance of the various units through which the signals travel.

A transmit antenna connecting system is often referred to as an antenna feed line.

The present invention concerns antennas which can be included in various types of device, including mobile telephones, base transceiver stations for mobile telephones, motor vehicles, aircraft and airborne missiles. In the case of a mobile telephone the continuous nature of the bottom ground layer of a microstrip antenna provides an easy way to limit the amount of radiated power intercepted by the body of the user of the device. In motor vehicles and above all in aircraft or missiles which have a metallic outer surface and a curved profile for low aerodynamic drag, the antenna can be conformed to the profile so that it does not cause unwanted additional aerodynamic drag.

The invention is more particularly concerned with the situation in which an antenna of the above kind is required to have the following qualities:

- it must be a dual frequency antenna, i.e. it must be capable of transmitting and/or receiving radiated waves efficiently on two widely spaced apart frequencies,
- it must be possible to connect it to a signal processor unit using a single connection line for all operating frequencies of a radiocommunication device, without giving rise to unwanted standing wave ratios on the line, and
- it must not be necessary to use a frequency multiplexer or demultiplexer to achieve this.

The prior art describes or proposes many dual frequency microstrip antennas. They differ in terms of the means employed to obtain a plurality of resonant frequencies. Three such antennas will now be considered:

A first prior art antenna is described in U.S. Pat. No. 4,766,440 (Gegan). The patch 10 of the antenna is generally rectangular and so the antenna has two half-wave resonances whose paths are along a length and a width of the patch. It also has a U-shaped curved slot which is entirely inside the patch. The slot is a radiating slot and produces an additional resonance mode on a different path. By appropriately choosing its shape and dimensions, the frequencies of the resonance modes are tuned to required values, which leads to the possibility of transmitting a circularly polarized wave by associating two modes having the same frequency and crossed linear polarizations. The coupling device is in the form of a microstrip line which is also coplanar in the sense that the microstrip is in the plane of the patch and penetrates between two notches in it. The device includes impedance converting means for matching it to the various input impedances of the line at the various resonant frequencies used as operating frequencies.

The first prior art antenna has the following drawbacks:

- Its implementation is complicated by the need to provide impedance converter means.
- It is difficult to adjust the resonant frequencies accurately to required values.

A second prior art antenna differs from the previous one in that it uses a single resonance path. It is described in U.S. Pat. No. 4,771,291 (LO et al.). Its patch incorporates localized short-circuits and slots extending along respective straight line segments within the patch. The slots and short-circuits reduce the difference between two frequencies corresponding to two resonances which share the path but have two different modes, respectively designated by the numbers (0, 1) and (0, 3), meaning that the common path is occupied by one half-wave or three half-waves, depending on the mode concerned. In this way the ratio between the two frequencies can be reduced from 3 to 1.8. The localized short-circuits are provided by conductors extending through the substrate.

The second prior art antenna has the following drawbacks:

- Its overall size corresponds to three half-waves.
- Incorporating localized short-circuits complicates the implementation of the antenna.
- The coupling device of the antenna, which is in the form of a coaxial line, requires accurate adjustment of the position of the coaxial structure passing through the substrate to obtain good matching to a feed line having an impedance of 50 ohms for the two operating frequencies.

A third prior art dual frequency antenna differs from the previous two in that it uses a quarter-wave resonance. It is described in IEEE ANTENNAS AND PROPAGATION SOCIETY INTERNATIONAL SYMPOSIUM DIGEST, NEWPORT BEACH, JUN. 18–23, 1995, pages 2124–2127 Boag et al. "Dual Band Cavity-Backed Quarter-wave Patch Antenna". A first resonance frequency is defined by the dimensions and the characteristics of the substrate and patch of the antenna. A resonance of substantially the same type is obtained on the same resonance path at a second frequency using a matching system.

The third prior art antenna has the following drawbacks:

- The difference between the two resonant frequencies is too small in some applications.
- The need to use a matching system complicates the implementation of the antenna.
- The same can apply to implementing the coupling device of the antenna in the form of a coaxial line.

OBJECTS AND SUMMARY OF THE INVENTION

The aims of the present invention include:

- enabling simple implementation of a dual frequency antenna, more particularly an antenna for which the ratio is in the range approximately 0.2 to approximately 0.8 and in particular around 0.5, by choosing more freely than previously the ratio between two wanted resonant frequencies of the antenna,
- giving the antenna a sufficiently wide bandwidth around each of the two resonant frequencies for a transmit frequency and a receive frequency to be situated within that bandwidth without crosstalk occurring,
- enabling easy and accurate adjustment of the two resonant frequencies,
- enabling use of a single coupling device whose impedance can easily be matched for each of the two resonant frequencies, and
- limiting the dimensions of the antenna.

With the above aims in view, the invention consists in particular in a dual frequency microstrip antenna. The antenna includes a patch having a rear edge, a front edge opposite the rear edge and two lateral edges joining the rear edge to the front edge. The rear edge has a short-circuit enabling a quarter-wave resonance to be established in the antenna with an electric field node fixed by the short-circuit and a resonance path extending between said rear edge and said front edge. The antenna further includes an antenna coupling device for coupling it to a signal processor unit such as a transmitter or receiver. Compared to the third prior art antenna previously mentioned, in the antenna in accordance with the invention, its coupling device is asymmetric so that one lateral edge of the patch differs from the other to enable the device to couple the antenna to the signal processor unit not only for said quarter-wave resonance but also for a half-wave resonance established in the antenna with a resonance path extending between the two lateral edges of the patch.

The present invention also consists in a dual frequency radiocommunication device including:

a signal processor unit adapted to be tuned to a frequency near to at least two predetermined frequencies to transmit and/or receive an electric signal at each of those two frequencies, and an antenna connected to the processor unit to couple said electric signal to radiated waves. The antenna is a microstrip antenna. Its patch has a rear edge provided with a short-circuit. It also has a front edge opposite the rear edge and two lateral edges joining the rear edge to the front edge. The short-circuit enables a quarter-wave resonance to be established in the antenna with an electric field node fixed by the short-circuit and a resonance path extending between said rear edge and said front edge. Said resonance is at a frequency which is one of said predetermined frequencies and constitutes a quarter-wave resonant frequency. In the device, the other predetermined frequency is a half-wave resonant frequency consisting of the frequency of a half-wave resonance established in the antenna with a resonance path extending between said two lateral edges. The types of resonance considered in the context of the invention are generally defined hereinabove.

Whatever the nature of the antenna coupling device used to enable the radiocommunication device to operate in two frequency bands centered respectively on the quarter-wave and on the half-wave resonant frequencies, the invention is advantageous if the ratio between the required two operating frequencies takes certain values, and more particularly if the ratio is in the range approximately 0.2 to approximately 0.8, in particular around 0.5. The advantage is that it enables the required ratio to be obtained relatively simply and efficiently by the combined use of two resonance modes, one of the quarter-wave type and the other of the half-wave type, established from traveling waves traveling across the same area in two crossing directions.

BRIEF DESCRIPTION OF THE DRAWINGS

Various aspects of the present invention will be better understood from the following description and the accompanying diagrammatic drawings. If the same component is shown in more than one figure it is designated by the same reference numerals and/or letters.

MORE DETAILED DESCRIPTION

Figure 1:
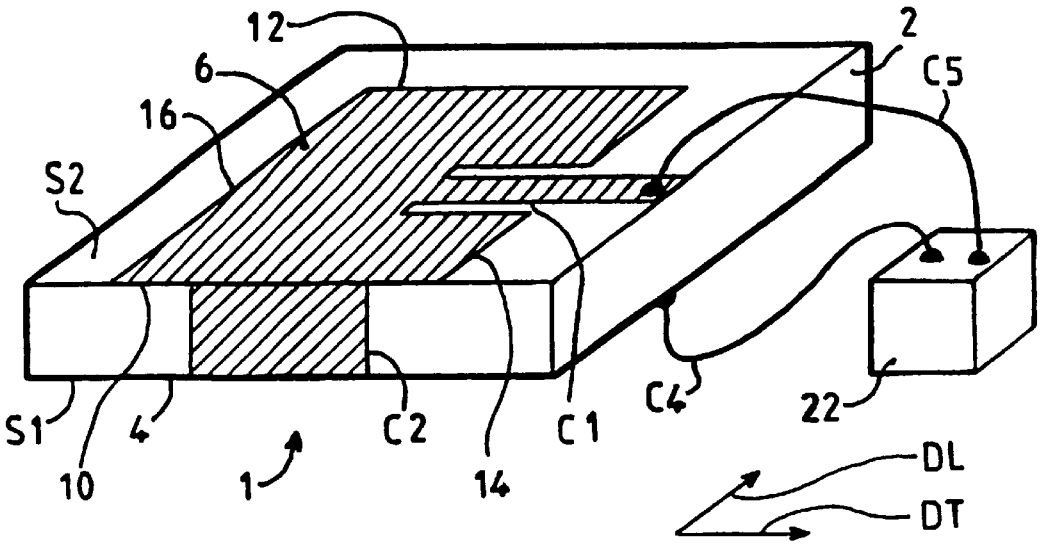
FIG. 1 is a perspective view of a radio-communication device in accordance with the invention.
Figure 2:
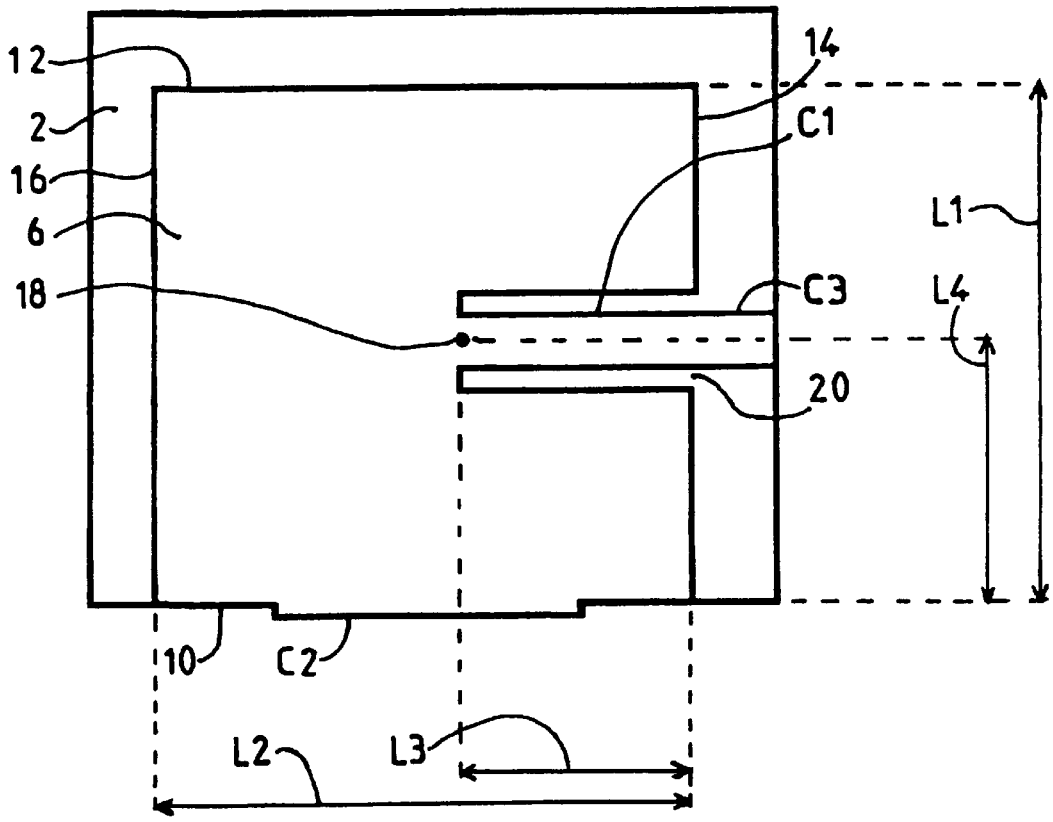
FIG. 2 is a plan view of the antenna from the device from FIG. 1.

As shown in FIGS. 1 and 2, and in a manner that is known per se, an antenna in accordance with the present invention includes a resonant structure including the following components:

A dielectric substrate 2 having two opposite main surfaces extending in directions defined in the antenna and constituting horizontal directions DL and DT, which directions may depend on the area concerned of the antenna. The substrate can have various shapes, as previously explained. Its two main surfaces are a bottom surface S1 and a top surface S2.

A bottom conductive layer extending over all of the bottom surface, for example, and constituting a ground 4 of the antenna.

A top conductive layer extending over an area of the top surface over the ground 4 to constitute a patch 6. The patch has a length and a width in said two horizontal directions that are defined hereinafter and which constitute a longitudinal direction DL and a transverse direction DT, respectively, and its periphery can be considered as comprising four edges in pairs substantially in those two directions. Although the words "length" and "width" usually apply to two mutually perpendicular dimensions of a rectangular object, the length being greater than the width, it must be understood that the patch 6 could have a non-rectangular shape without departing from the scope of the invention. More particularly, the directions DL and DT can be at an angle other than 90 degrees to each other, the edges of the patch can be non-rectilinear and not separated by angular corners, and the length of the patch can be shorter than its width. One edge extends in the transverse direction DT and constitutes a rear edge 10. A front edge 12 is opposite the rear edge. Two lateral edges 14 and 16 join the rear edge to the front edge.

Finally, a short-circuit C2 electrically connecting the patch 6 to the ground 4 from the rear edge of the patch. The short-circuit is formed by a conductive layer extending over an edge surface of the substrate which is typically plane in which case it constitutes a short-circuit plane. It obliges a resonance of the antenna to have an electric field node at the rear edge 10 and to be at least approximately of the quarter-wave type. The frequency of this resonance will be called the "quarter-wave resonant frequency" hereinafter. The rear, front and lateral edges and the longitudinal and transverse directions are defined by the position of a short-circuit of the above kind if the short-circuit is sufficiently clear, i.e. sufficiently extensive and of sufficiently low impedance to impose a quarter-wave resonance on the antenna.

The antenna further includes a coupling device. The device includes a main conductor consisting of a coupling strip C1 on the top surface S2 of the substrate and connected to the patch 6 at an internal connection point 18. It also includes a ground conductor consisting of the layer 4. It constitutes all or part of a connecting system that connects the resonant structure of the antenna to a signal processor unit 22, for example to excite one or more resonances of the antenna from the unit in the case of a transmit antenna. In addition to this device, the connecting system typically includes a connection line external to the antenna. This line can be of the coaxial, microstrip or coplanar type.

In the context of the present invention at least a fraction of a length of the connection line is advantageously of the microstrip type and more particularly includes:

a main conductor in the form a connecting strip C3 on the top surface S2 of the substrate 2 and continuous with the coupling strip C1, and a ground conductor on the bottom surface of the substrate and continuous with the ground of the antenna. Like the antenna ground, this conductor is the bottom conductive layer 4, for example.

In FIG. 1, the remaining portion of the connection line is symbolized as two conductive wires C4 and C5 respectively connecting the ground 4 and the strip C3 to two terminals of the signal processor unit 22. However, it should be understood that in practice this remaining portion is preferably in the form of a microstrip or coaxial line.

The signal processor unit 22 is adapted to operate at predetermined operating frequencies which are at least close to the wanted resonant frequencies of the antenna, i.e. which are in bands centered on those resonant frequencies. It can be composite, in which case it includes a component tuned permanently to each operating frequency. It can equally include a component that can be tuned to the various operating frequencies. The quarter-wave resonant frequency constitutes one such wanted resonant frequency.

In accordance with the invention, another wanted resonant frequency is a half-wave resonant frequency consisting of the frequency of a half-wave resonance established in the antenna with a resonance path between the two lateral edges 14 and 16.

For the radio communication device in accordance with the invention to be able to operate, the antenna coupling device must be capable of fulfilling its coupling function both at the quarter-wave resonant frequency and at the half-wave resonant frequency. In one embodiment of the invention this capability is obtained by virtue of the fact that the device is asymmetric relative to a longitudinal axis of the antenna, not shown, so that one of the two lateral edges of the patch is different from the other one. This asymmetry of the coupling device can be obtained in various ways that are known per se. It can in particular affect the position, orientation and/or dimensions of the device or part of the device. It has nevertheless become clear that implementing it in the form of a coaxial line would be inappropriate, at least if the line were vertical. The device can advantageously be formed using a planar technique for the patch and/or the antenna ground.

The patch 6 is the usual rectangular shape and the asymmetry of the coupling device of the antenna can advantageously be obtained by the following arrangement: the patch 6 has a coupling input slot 20 opening to the exterior of the patch at a first lateral edge 14 of the patch and extending to an end of the slot from this first lateral edge, for example in the transverse direction DT. A coupling strip C1 extends from the first lateral edge on the top surface of the substrate inside the coupling input slot. It is connected to the patch at the end of the slot, this end constituting an internal connection point 18. The distances from this point to a first lateral edge 14 and the rear edge 10 respectively constitute a connecting depth L3 and a connecting dimension L4. The ground conductor of the antenna coupling device is the ground 4 of the antenna.

The ratio L1/L2 of the length of the patch to its width is preferably in the range approximately 2.5 to approximately 0.625.

The connecting depth L3 is preferably in the range approximately 8% to approximately 25% of the width L2 of he patch 6.

The connecting dimension L4 is preferably in the range approximately 25% to approximately 75% of the length L1 of the patch 6.

The short-circuit C2 preferably occupies only a segment of the rear edge 10 and that segment has a length in the range 10% to 90% of the width L2 of the patch 6.

With the aim of providing a numerical example, various compositions and values are given hereinafter for one embodiment of an antenna in accordance with the invention. The length and width of the substrate are respectively in the longitudinal direction DL and the transverse direction DT.

quarter-wave resonant frequency: F1=980 MHz, half-wave resonant frequency: F2=1900 MHz, input impedance: 50 ohms, composition and thickness of substrate: epoxy resin with relative permittivity $\epsilon_r$ equal to 3 and dissipation factor tanδ equal to 0.003, thickness of substrate: 2 mm, composition of conductive layers: copper, thickness of conductive layers: 17 microns, length of substrate: 65 mm, width of substrate: 70 mm, length of patch: L1=60 mm, width of patch: L2=60 mm, connecting depth: L3=10 mm, connecting dimension: L4=30 mm, width of conductors C1 and C3: 5 mm, width of slot 20: 0.7 mm, width of short-circuit conductor C2: 36 mm.

Figure 3:
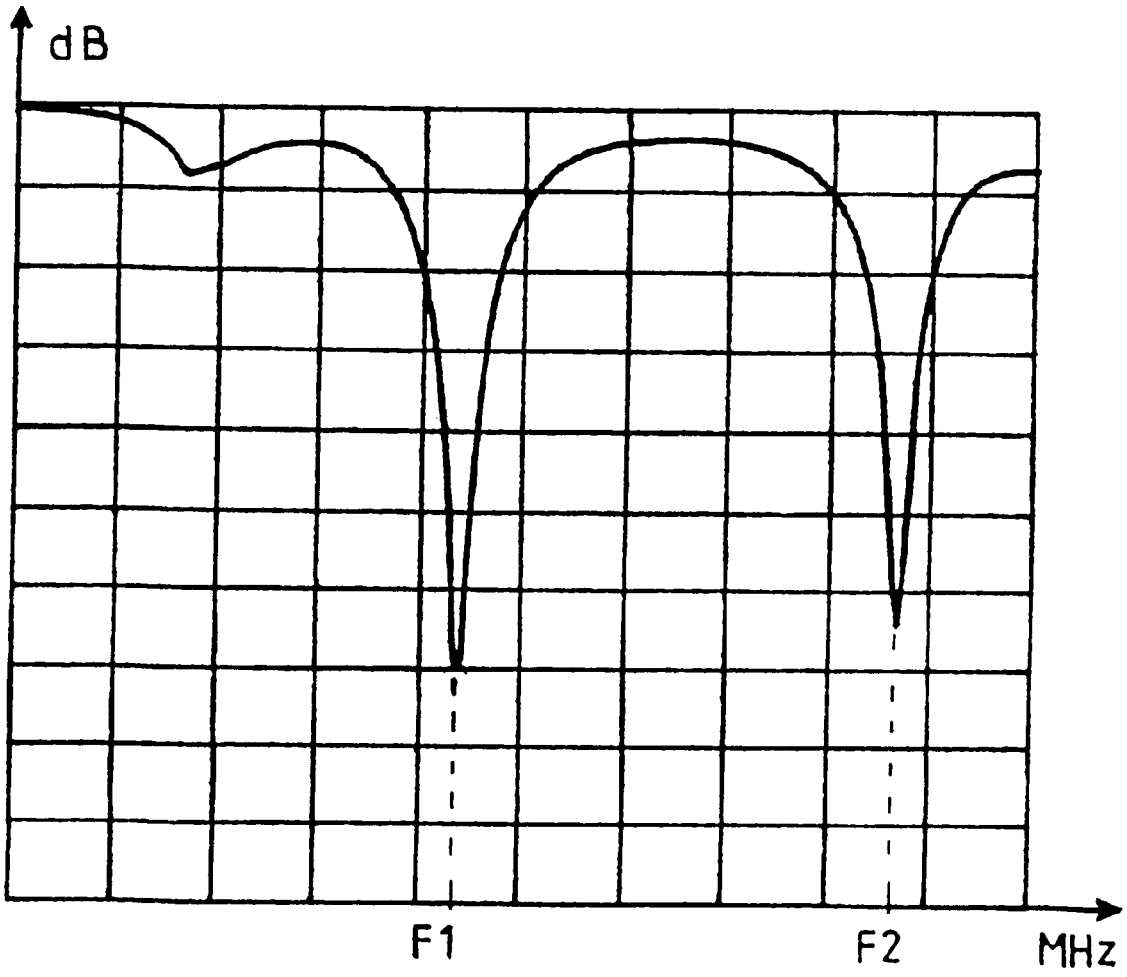
FIG. 3 is a graph showing how a reflection coefficient as measured at the input of the antenna and plotted up the ordinate axis varies as a function of the frequency of a signal feeding the antenna and plotted along the abscissa axis.

The FIG. 3 graph was plotted from measurements on an antenna with the above numerical characteristics. In FIG. 3 the top horizontal line is the 0 dB level. The distance between two horizontal lines is 3 dB. The extreme frequencies of the scale represented are 200 MHz and 2000 MHz. The distance between two vertical lines is 180 MHz. The resonant peaks in the diagram correspond to the previously indicated quarter-wave resonant frequency F1 and half-wave resonant frequency F2.

The present invention can be applied with particular advantage to a mobile telephone system. A system of this kind includes base transceiver stations and portable terminals using frequencies around 900 MHz (GSM) or around 1800 MHz (DCS). In a system of this kind the base transceiver stations or the portable terminals can each include a radiocommunication device in accordance with the invention. In a device of this kind suited to this use the antenna has to operate in a high frequency band around said half-wave resonant frequency and in a low frequency band around said quarter-wave resonant frequency. Said signal processor unit 22 can then be tuned to four different operating frequencies:

a high transmit frequency in said high frequency band, a high receive frequency in said high frequency band, a low transmit frequency in said low frequency band, a low receive frequency in said low frequency band.

It can respectively transmit or receive a signal when it is tuned to one of said transmit frequencies or to one of said receive frequencies.

The invention enables the two frequency bands to be wide enough not only to prevent crosstalk between transmit and receive channels in the band but also to enable a choice between a plurality of possible positions of the channels in the band. The low frequency band corresponds to the GSM standard and the high frequency band to the DCS standard. In this way dual mode terminals and/or base receiver stations are economically obtained, i.e. terminals and/or base transceiver stations able to operate under any of the above standards.

For example, in the case of an antenna with the numerical characteristics set out hereinabove, the high transmit and receive frequencies can be 1750 MHz and 840 MHz, respectively, and the low transmit and receive equencies can be 890 MHz and 940 MHz, respectively.

What is claimed is:

1. A dual frequency radiocommunication device including:

a signal processor unit adapted to be tuned to a frequency near at least two predetermined frequencies to transmit and/or receive an electric signal at each of those two frequencies; and a microstrip antenna connected to that processor unit to couple said electric signal to radiated waves, said antenna having a patch with a front edge, a rear edge and two lateral edges joining said front and rear edges, said rear edge provided with a short-circuit setting up a quarter-wave resonance in said antenna with an electric field node fixed by the short-circuit and a resonance path extending between said rear edge and said front edge, a distance between said front and rear edges being such that said resonance path between said front and rear edges has a quarter-wave resonant frequency which is one of said predetermined frequencies;

wherein a distance between said two lateral edges is such that a path extending between said two lateral edges has a half-wave resonant frequency which is the other of said predetermined frequencies.

2. A radiocommunication device according to claim 1, said antenna being adapted to operate in a high frequency band near said half-wave resonant frequency and a low frequency band near said quarter-wave resonant frequency, said signal processor unit being adapted to be tuned to four different predetermined frequencies:

a high transmit frequency in said high frequency band, a high receive frequency in said high frequency band, a low transmit frequency in said low frequency band, and a low receive frequency in said low frequency band, the processor unit being respectively adapted to transmit or receive a signal when it is tuned to one of said transmit frequencies or one of said receive frequencies.

3. A dual frequency radiocommuncation device comprising:

a signal processor unit adapted to be tuned to a frequency new at least two predetermined frequencies to transmit and/or receive an electric signal at each of those two frequencies; and a microstrip antenna connected to that processor unit to couple said electric signal to radiated waves, a patch of the antenna having a rear edge provided with a short-circuit, a front edge opposite the rear edge and two lateral edges joining the rear edge to the front edge, said short-circuit enabling a quarter-wave resonate to be established in said antenna with an electric field node fixed by the short-circuit and a resonance path extending between said rear edge and said front edge, said quarter-wave resonance having a quarter-wave resonant frequency which is one of said predetermined frequencies;

wherein the other of said predetermined frequencies is a half-wave resonant frequency consisting of the frequency of a half-wave resonance established in the antenna with a resonance path extending between said two lateral edges, and said antenna further comprises:

a dielectric substrate having two opposite main surfaces extending in directions defined in said antenna and constituting horizontal directions, the two surfaces respectively constituting a bottom surface and a top surface, a bottom conductive layer on said bottom surface and constituting a ground of the antenna, a top conductive surface on an area of said top surface over said ground and constituting said patch, said short-circuit electrically connecting said patch to said ground from said rear edge of the patch, this edge extending in a horizontal direction constituting a transverse direction, a length of the patch extending between the rear edge and said front edge in a longitudinal direction which is one of said horizontal directions, said two lateral edges of said patch respectively constituting a first lateral edge and a second lateral edge, a width of the patch extending between the two lateral edges, and an antenna coupling device including:

a main conductor, and a ground conductor enabling said antenna to be coupled to said signal processor unit via the antenna coupling device at each of said predetermined frequencies, wherein said patch has a coupling input slot opening to the exterior of the patch via said first lateral edge of the patch and extending from the first lateral edge substantially in said transverse direction as far as an end of the slot, said main conductor of the antenna coupling device having the form of a coupling strip extending from said first lateral edge of the patch on said top surface of the substrate inside said coupling input slot, the strip being connected to the patch at said end of the slot, this end constituting an internal connection point, the distances from this point to the first lateral edge and said rear edge respectively constituting a connecting depth and a connecting dimension, said ground conductor of the antenna coupling device consisting of said antenna ground.

4. A radiocommunication device according to claim 3, the ratio of said length of the patch to said width of the patch being in the range approximately 2.5 to approximately 0.625.

5. A radiocommunication device according to claim 4, said connecting depth being in the range approximately 8% to approximately 25% of said width of the patch.

6. A radiocommunication device according to claim 4, said connecting dimension being in the range approximately 25% to approximately 75% of said length of the patch.

7. A radiocommunication device according to claim 4, said short-circuit occupying a segment of said rear edge of the patch having a length in the range 10% to 90% of said width of the patch.

8. A radiocommunication device according to claim 3 further including a connection line extending to the exterior of said antenna for connecting said antenna coupling device to said signal processor unit, at least a portion of a length of the connection line including:

a main conductor having the form of a connecting strip on said top surface of the substrate and continuous with said coupling strip, and a ground conductor on said bottom surface of the substrate and continuous with said ground of the antenna.

9. A dual frequency microstrip antenna including:

a patch having a rear edge provided with a short-circuit, a front edge opposite the rear edge and two lateral edges joining the rear edge to the front edge, said short-circuit setting up a quarter-wave resonance in said antenna with an electric field node fixed by the short-circuit and a resonance path extending between said rear edge and said front edge, and an antenna coupling device for coupling the antenna to a signal processor unit, wherein said antenna coupling device is asymmetric so that one lateral edge of the patch differs from the other lateral edge of the patch, setting up a half-wave resonance in said antenna with a resonance path extending between said two lateral edges of the patch, to enable the device to couple the antenna to said signal processor unit not only for said quarter-wave resonance but also for said half-wave resonance.

10. An dual frequency antenna comprising:

a patch having a rear edge provided with a short-circuit, a front edge opposite the rear edge and two lateral edges joining the rear edge to the front edge, said short-circuit enabling a quarter-wave resonance to be established in said antenna with an electric field node fixed by the short-circuit and a resonance path extending between said rear edge and said front edge; and an antenna coupling device for coupling the antenna to a said processor unit, wherein said antenna coupling device is asymmetric so that one lateral edge of the patch differs form the other lateral edge of the patch to enable the device to couple the antenna to said signal processor unit not only for said quarter-wave resonance but also for a half-wave resonance established in said antenna with a resonance path extending between said two lateral edges of the patch, and further comprising:

a dielectric substrate having two opposite main surfaces extending in horizontal directions defined in the antenna the two surfaces respectively constituting a bottom surface and a top surface, a bottom conductive layer on said bottom surface and constituting a ground of the antenna, a top conductive layer on an area of said top surface over said ground and constituting said patch, said short-circuit, electrically connecting the patch to said ground from said rear edge of the patch, this edge extending in one of said horizontal directions constituting a transverse direction, a length of the patch extending between the rear edge and said front edge in a longitudinal direction which is one of said horizontal directions, said two lateral edges of the patch respectively constituting a first lateral edge and a second lateral edge, a width of the patch extending between the two lateral edges, and said antenna coupling device including:

a main conductor, and a ground conductor enabling said antenna to be coupled to a signal processor unit via the device, wherein said patch includes a coupling input slot opening to the exterior of the patch via said first lateral edge of the patch and extending from the first lateral edge substantially in said transverse direction far as an end of the slot, said main conductor of the antenna coupling device having the form of a coupling strip extending from said first lateral edge of the patch on said top surface of the substrate inside said coupling input slot, the strip being connected to said patch at said end of the slot, said ground conductor of the antenna coupling device consisting of said ground of the antenna.

* * * * *